United States Patent [19]

Risley

[11] Patent Number: 4,696,738

[45] Date of Patent: Sep. 29, 1987

[54] MATERIAL SEPARATING SURFACE

[76] Inventor: Charles N. Risley, 2949 SE. Walta Vista Ct., Milwaukie, Oreg. 97222

[21] Appl. No.: 714,002

[22] Filed: Mar. 20, 1985

[51] Int. Cl.[4] ..... B07B 1/04; B07B 1/46

[52] U.S. Cl. ..... 209/352; 209/281; 209/400; 209/408; 209/674

[58] Field of Search ..... 209/674, 675, 677, 678, 209/679, 680, 682, 233, 281, 352, 400, 282, 283, 357, 358, 405, 408

[56] References Cited

U.S. PATENT DOCUMENTS

| | | | |
|---|---|---|---|
| 174,828 | 3/1876 | Leeson | 209/400 |
| 447,901 | 3/1891 | Perry | 209/400 X |
| 878,728 | 2/1908 | Harrop | 209/400 |
| 1,739,701 | 12/1929 | Wilson | 209/400 |
| 2,283,877 | 5/1942 | Heller | 209/400 |
| 2,314,878 | 3/1943 | Heller | 209/400 |
| 2,728,455 | 12/1955 | Greiner . | |
| 2,837,210 | 6/1958 | Ackert et al. | 209/400 |
| 2,907,404 | 10/1959 | Mare | 209/400 X |
| 3,779,379 | 12/1973 | Buchbinder et al. . | |
| 3,977,525 | 8/1976 | Lamborn . | |
| 4,140,630 | 2/1979 | Scarlett et al. | 209/400 X |
| 4,247,007 | 1/1981 | Kai | 209/400 X |

FOREIGN PATENT DOCUMENTS

| | | | |
|---|---|---|---|
| 0266791 | 9/1964 | Australia | 209/677 |
| 0360531 | 6/1938 | Italy | 209/400 |
| 1218225 | 1/1971 | United Kingdom | 209/281 |

*Primary Examiner*—Robert B. Reeves
*Assistant Examiner*—Edward M. Wacyra
*Attorney, Agent, or Firm*—Chernoff, Vilhauer, McClung & Stenzel

[57] ABSTRACT

An aggregate separator has a fan-shaped separating surface made up of an array of diverging end-stretched wires which are permitted to oscillate individually in response to vibratory stimulus. The surface includes a plurality of identical fan-shaped panels, each panel including a plurality of wires and a pair of end sheaths which retain the ends of the wires in fixed relation to each other so that the wires of each panel diverge. Each panel is stretched on the frame of the separator until the length and tension of the wires are substantially the same. Intermediate transverse bridges may be used to position the wires between the upstream and downstream ends of the separator and ensure that the effective spacing between adjacent oscillating wires does not exceed the exit interval.

4 Claims, 10 Drawing Figures

MATERIAL SEPARATING SURFACE

BACKGROUND OF THE INVENTION

This invention relates to material separating devices and particularly to an aggragate separator having a separating surface of diverging end-stretched wires.

Traditional aggragate separators for separating sand and gravel are heavy bins having a separating surface or a plurality of separating surfaces which are typically made of a heavy wire mesh or parallel tensioned wires. In most applications these separating surfaces are sloped or employed in combination with a conveyor to move the bulk material to be separated across the separating surface. Vibrating or aggitating the separator serves several purposes, it tends to turn the material over so that more of the smaller particles are exposed to the separating surface, it tends to break the clumps of particles apart, and it also tends to reduce the friction between the separating surface and the material to enhance the material flow across the surface. Scarlett et al., U.S. Pat. No. 4,140,630, is illustrative of many of the features described above.

Other types of separators auch as the food graders of Greiner, U.S. Pat. No. 2,728,455, and Lamborn, U.S. Pat. No. 3,977,525, disclose a separating surface having a plurality of longitudinally-extending rigid members which diverge from each other in the direction of material flow. Buchbinder, U.S. Pat. No. 3,779,379, discloses a rubbish sorter having a separating surface of diverging, widely spaced moving belts which turn the rubbish over to separate smaller particles of the trash from the bulkier items.

SUMMARY OF THE INVENTION

The present invention includes a fan-shaped separating surface of longitudinally-extending, diverging, end-stretched wires which are permitted to oscillate individually in response to vibratory stimulus. The surface does not include any transverse members, and employs transverse bridges only to the extent necessary to space the tensioned wires from each other and to control their oscillating length to ensure that the effective space between adjacent oscillating wires continues to increase in the direction of material flow.

The surface is divided into a plurality of identical, interchangeable panels, each panel assembly including a plurality of wires held in diverging spaced relation to each other by a pair of sleeves, one sleeve at each end of the panel. Each panel assembly is stretched on the frame of the separator. Since the panels are identical, the resulting surface resembles a radial fan with each of the panels corresponding to a radial segment of a common circle. Consequently each of the panels may be removed, repaired or replaced as necessary without removing or disturbing the remaining panels. To ensure that all the wires of a panel are of the same length and have similar oscillating characteristics, each panel is stretched until the wires comprising the panel have substantially approached or exceeded their yield strength. This stretches the shorter wires slightly. Such high tension also results in a lively surface, the wires tending to oscillate at a greater frequency and lower amplitude than a slack surface.

The lack of transverse members in the separating surface also contributes to achieving a very "live" separating surface. If transverse bridges are employed to control effective spacing of the wires, such bridges are arranged closer together toward the downstream end of the surface to ensure that the effective spacing between the oscillating wires does not exceed the exit spacing of the wires of the aurface and cause material to wedge in the screen.

The use of thin, end-stretched wires without transverse members and the employment of compression members substantially in line with the tensioned wires allows the separator to be very light in comparison to typical separators of similar capacity and permits the entire separator to be suspended from the end of a conveyor, or to be supported from beneath with a lesser requirement for a supporting structure.

Accordingly, it is a principal objective of the present invention to provide a separating surface including a plurality of longitudinally extending, diverging, tensioned wires.

It is an associated object of the present invention to provide such a surface which permits each of the tensioned wires to oscillate individually in response to vibratory stimulus.

It is a further object of the present invention to provide such a surface wherein the actual and effective spacing of the wires of the surface continually increases in the direction of material flow.

It is another object of the present invention to provide such a surface which includes a plurality of identical interchangeable panels, each panel including a plurality of wires.

It is a related object of the present invention to provide such a surface wherein individual panels may be removed or replaced without disturbing or removing the panels comprising the remainder of the surface.

It is a further object of the present invention to provide a separating surface comprised primarily of thin end stretched wires which is substantially smaller and lighter than separators of similar capacity.

DETAILED DESCRIPTION OF THE INVENTION

Figure 1:
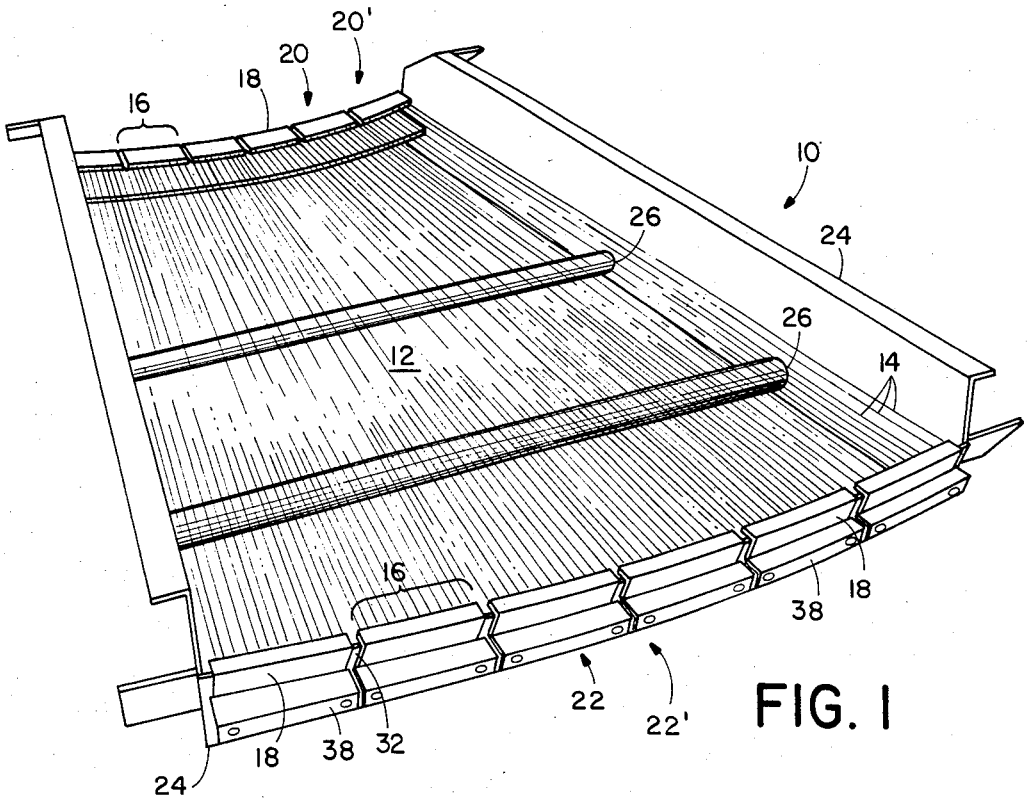
FIG. 1 is a perspective view of the top of the separator of the present invention.
Figure 2:
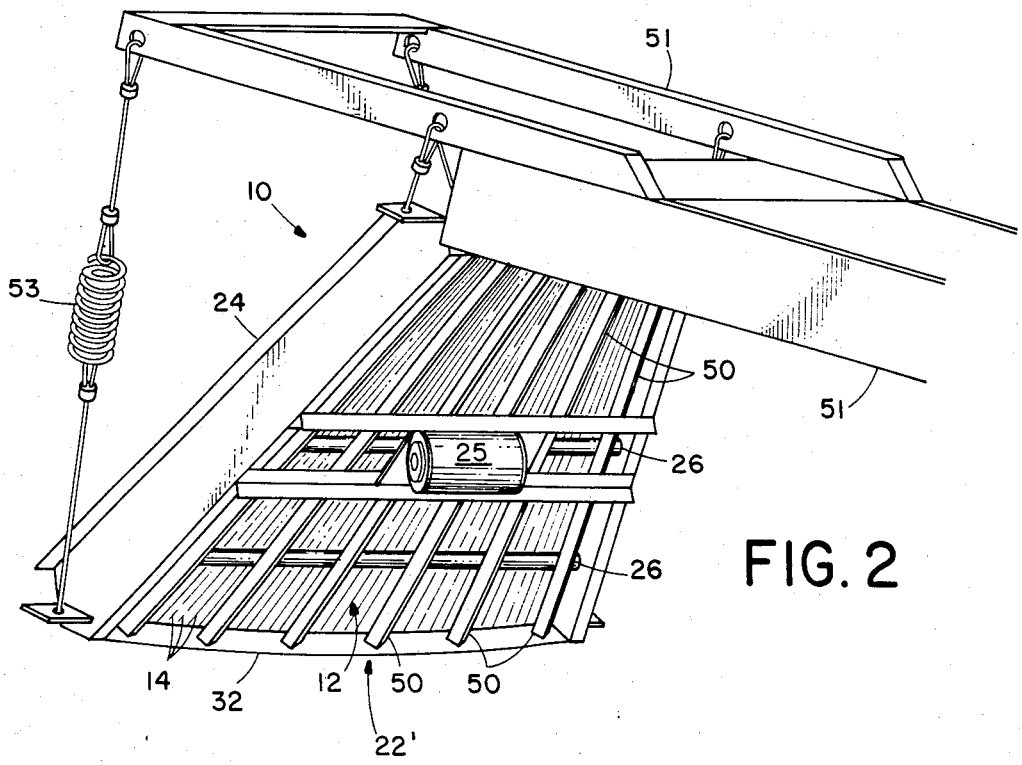
FIG. 2 is a perspective view of the underside of the separator of FIG. 1 shown suspended from the end of a conveyor.

As shown in FIGS. 1 and 2, the aggragate separator 10 of the present invention includes a fan-shaped separating surface 12 made up of a plurality of thin, longitudinally-extending, end-stretched wires 14.

Figure 3:
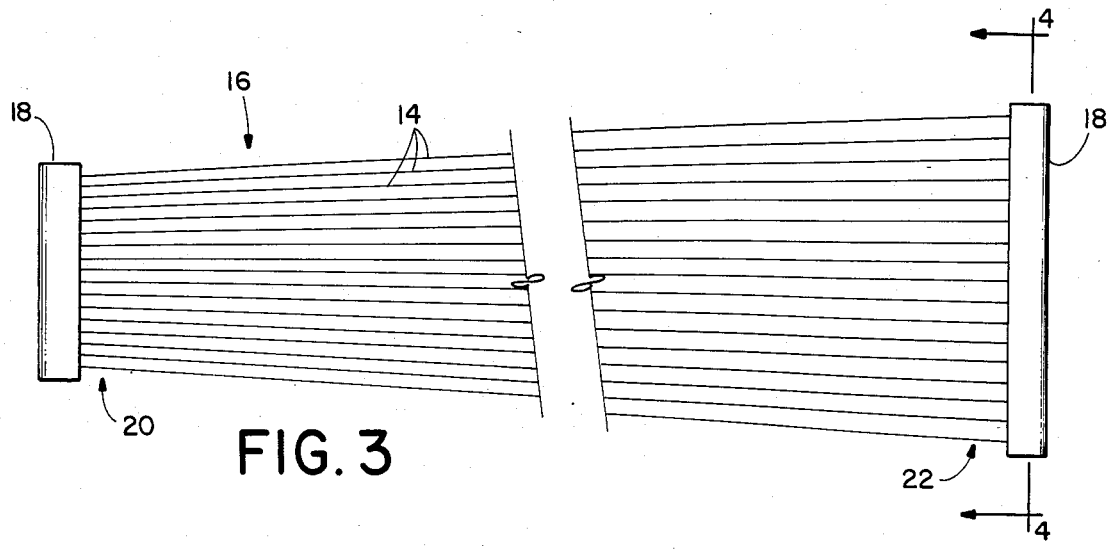
FIG. 3 is a foreshortened plan view of one of the panels comprising the surface of the separator of FIG. 1.

The surface is divided into a plurality of identical panels 16, one of which may be seen in FIG. 3, each panel including a plurality of wires. The wires of a panel are held in spaced relation to each other at each end of the panel by a pair of end sheaths 18, which respectively receive and retain the end of each wire in spaced relation to its adjacent wires. Each panel has a relatively narrow "upstream" end 20 where the wires are spaced relatively close to each other and a relatively wide "downstream" end 22 where the wires are spaced more widely apart.

Each panel is individually mounted and stretched on a fan-shaped frame 24 having its narrow upstream end 20 at the narrow upstream end 20' of the frame and its wide downstream end 22 at the wide downstream end 22' of the frame. Accordingly, the identical panels are arranged on the frame in a radial fan design, each of the panels corresponding to a partial radial segment of a common circle. As a result, the upstream and downstream ends 20' and 22' of the frame approximate circumferential segments of two concentric circles.

The separator also includes a vibrating motor 25 mounted to the frame of the separator and may include one or more tranverse bridges 26 as will be explained below.

Figure 4:
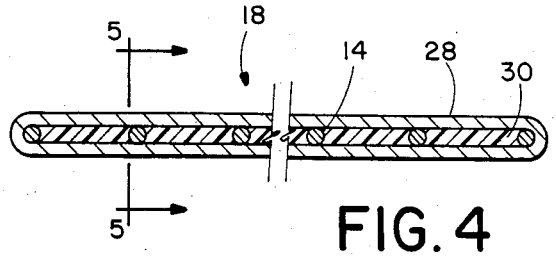
FIG. 4 is a cross-sectional view of the panel of FIG. 3 taken along lines 4—4.
Figure 5:
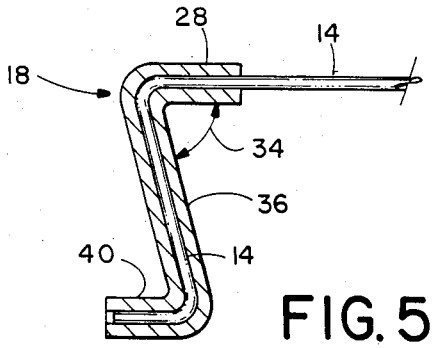
FIG. 5 is a partial cross-sectional view of the panel of FIG. 3 taken along lines 5—5 of FIG. 4.

Turning to FIGS. 3, 4 and 5, a panel 16 shown in FIG. 3 includes only a plurality of wires 14 and a pair of end sheaths 18. Consequently, the panel has no inherent structural rigidity. The end sheaths of the panel each include a band 28 which is wrapped transversely around the ends of the wires. A flexible adhesive 30 fills the space between the wires as shown in FIG. 4 and serves to space the wires in a predetermined preferred relationship as well as retain the wires within the sheath.

Figure 6:
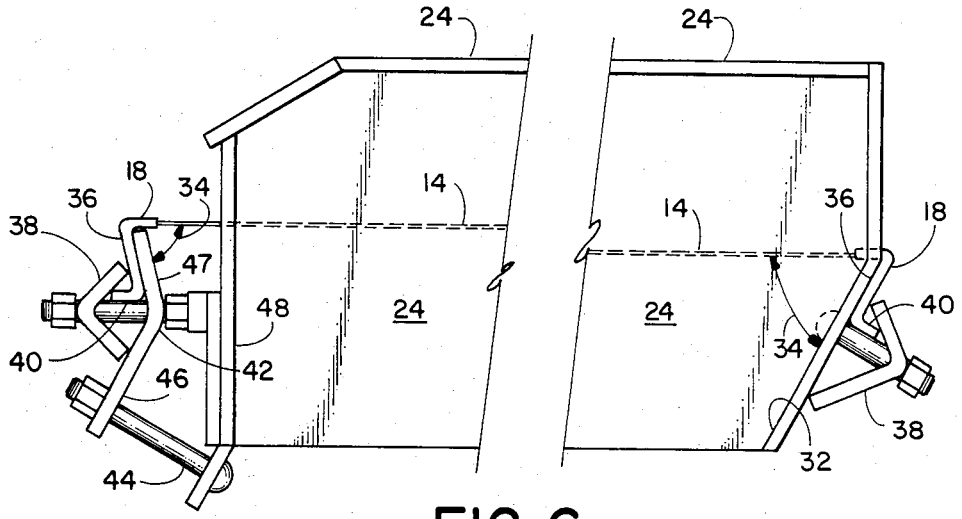
FIG. 6 is a partial elevational view showing how the panel of FIG. 3 is attached to the separator of FIG. 1.

After the sheath has been assembled and the adhesive cured, the sheaths are deformed into a "Z" shape as may be seen in FIGS. 5 and 6. For this reason the adhesive must be deformable. Applicant has found that a flexible/high strength adhesive is preferable to welding or brazing since these latter techniques tend to destroy desired properties of the metal. Of course, any other construction technique which would space the wires, retain the wires in place under great tension, yet allow the sheaths to be deformed into the Z shape may be suitable.

Turning to FIG. 6, it may be seen how the panels 16 are stretched on the frame 24 and how the Z-shaped sheathes contribute to the stretching operation. The downstream lip 32 of the frame is slanted with respect to the plane of the separating surface 12 so as to form an acute angle 34 therewith. This acute angle corresponds to the acute angle 34 formed between the wires 14 exiting the sheath 18 and a flat trunk 36 of the Z-shaped sheath shown in FIG. 5. Returning to FIG. 6, with further reference to FIG. 1, it can be seen that the flat trunk 36 of the sheath forms a large area of contact with the downstream lip 32. This large surface contact area. in conjunction with the acute angle 34. allows the panel to be tensioned with great force yet discourages slippage or failure of the panel/frame connection. As may be seen in FIGS. 1 and 6, a keeper bar 38 corresponding generally to the downstream sheath 18 is employed to hold the sheath against the downstream lip, the keeper bar being angled and oriented so as to cooperate with the tail 40 of the z-shaped sheath to retain the sheath and panel on the downstream lip.

The same technique, with respect to the acute angle 34 and the flat trunk 36 of the Z-shaped sheath, as explained above and as shown in FIG. 6, is employed at the upstream end 20' of the separator to retain the panel on the frame and to apply tensioning force to the wires of the panel. However, at the upstream end a rocker bar 42 forming the same acute angle 34 with the plane of the panel is employed rather than a fixed portion of the frame. As explained above, a keeper bar 38 is employed to releasably fix the sheath to the rocker bar. Tightening bolts 44 which extend between the lower arm 46 of the rocker bar and the frame cause the upper arm 47 of the rocker bar to move in an upstream direction to tension the wires of the panel. As may be discerned in FIG. 6, the lower arm 46 of the rocker bar 42 is longer than the upper arm 47 giving the tightening bolts 44 a mechanical advantage. It will be readily understood that such a stretching arrangement preferable to an "in line" stretching mechanism which applies the full tensioned force to the operable stretching element.

In order to achieve a live surface, it is desirable that the wires of the surface be sufficiently tensioned to achieve the preferred oscillating characteristics. The panel construction of the separator does not allow each wire to be individually tensioned. Indeed, it would be very time-consuming to tension each wire individually, and very expensive to build a separator with such capability. The panel construction of the present invention enahles all the wires of a panel to be tensioned simultaneously. However, in order for the wires of a panel to be tensioned to a substantially similar degree, the wires must all be of identical length. Since it is difficult to construct a panel having wires that are all of the same length, the panel is stretched until the yield strength of the shorter wires of the panel is approached or exceeded, thereby stretching the shorter wires until all wires of the panel are of substantially the same length and therefore subject to similar tension.

A highly tensioned surface also contributes to the liveliness of the surface and its separating capacity. A slack surface has a wild, floppy oscillation characteristic, the lack of tension tending to increase the wavelength and amplitude of the oscillating wires. In contrast, a surface of highly tensioned wires tends to oscillate in a high-frequency, low-amplitude vibration. As will be explained below, the low amplitude is particularly important in view of the diverging pattern of the wires. For the reasons set forth above, the vibrating motor 25 preferably has high-frequency, low-amplitude characteristics.

Returning to FIGS. 1 and 2, the frame 24 of the separator includes side members, a downstream lip 32 and an upstream lip 48. The frame also includes a plurality of braces 50 extending between the downstream lip and the upstream lip. These braces diverge in the direction of material flow and are therefore substantially parallel to the panels which make up the surface. As may be seen in FIG. 2, the braces are arranged beneath and closely adjacent to the separating surface. Accordingly, the braces act as compression members which are substantially in line with the tensioned wires of the surface. Such an arrangement means that the upstream and downstream lips do not have to be contructed to transfer the compressive forces of the tensioned wires to the side members, permitting the frame of the separator to be constructed from lighter material and, in conjunction with the use of relatively light, thin, end-stretched wires enabling the entire separator assembly to be sufficiently light to be hung from the end of a conveyor or easily supported from beneath.

It should be noted that the separator of the present invention should be supported in such a fashion as to avoid dampening the vibration caused by the motor 25. FIG. 2 shows a separator suspended from a conveyor 52 by springs 53. As an alternative to the arrangement shown in FIG. 2, the separator could be supported from beneath by resilient air bags, rubber cushions or the like.

As may be seen in FIGS. 1, 3, 7, and 10, each of the panels comprising the surface includes a plurality of end-stretched wires which diverge from each other in the direction of material flow. Accordingly, the interval 52 between adjacent wires increases in the direction of material flow. It will be understood that the entrance interval 52' at the upstream lip 48 and the exit interval 52" at the downstream lip 32 are fixed by the respective sheathes 18. Therefore, when the separating surface is at rest, the entrance interval 52' is smaller than the static interval 52 anywhere on the surface, which in turn is smaller than the exit interval 52". Under such conditions, particles are not likely to become wedged in between the wires of the surface since the flow of material urges particles downstream toward a wider interval 52. Applicant has found that the taper or rate of divergence of adjacent wires is preferably between 0.020 and 0.050 inches per foot.

Figure 10:
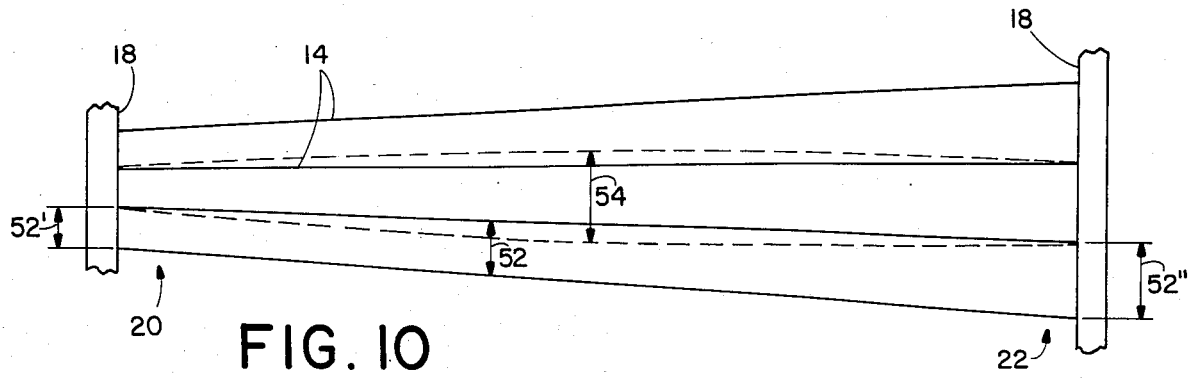
FIG. 10. is a fragmentary schematic plan view of the portion of the separating surface shown in FIG. 7, without transverse bridges.

However, aggitating or vibrating the surface changes the effective spacing 54 between adjacent wires because each wire is allowed to oscillate individually. Accordingly, at any given time the effective spacing 54 between adjacent wires is likely to be greater than the static interval 52. Although the actual amplitude of an oscillating wire under operating conditions would be a function of many complex factors, generally the amplitude of the wire would be greatest at a point equidistant from its supported ends, and would increase as the unsupported length of the wire increases. Therefore, if the length of unsupported wire is sufficiently long, the effective spacing 54 could be larger than the fixed exit interval 52", as illustrated in FIG. 10. Such a situation could cause particles to wedge in the wires of the surface and clog the separator.

Figure 7:
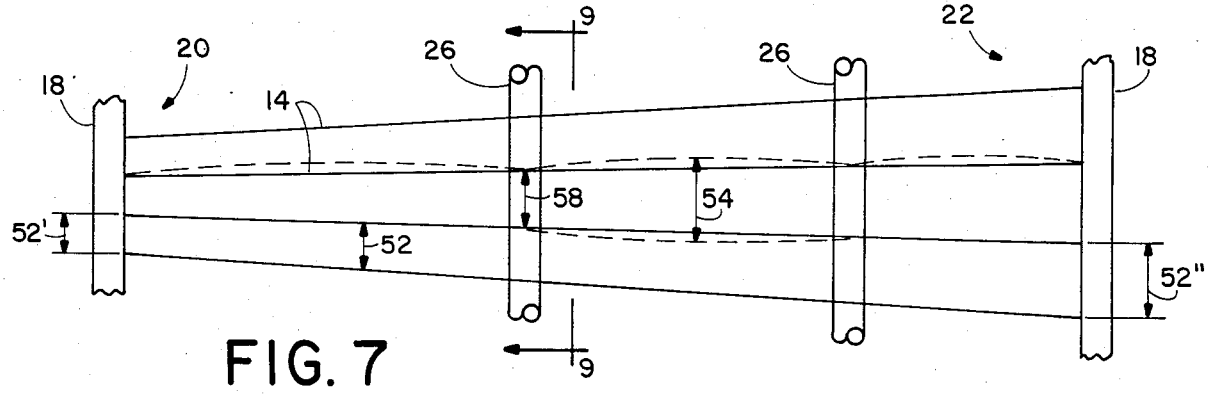
FIG. 7 is a fragmentary schematic plan view of a portion of the separating surface of the separator of FIG. 1.
Figure 8:
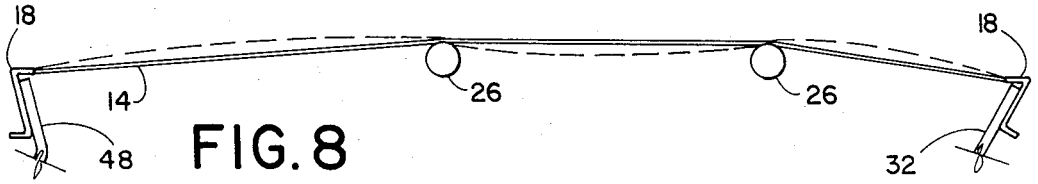
FIG. 8 is a schematic elevational view of the portion shown in FIG. 7.
Figure 9:
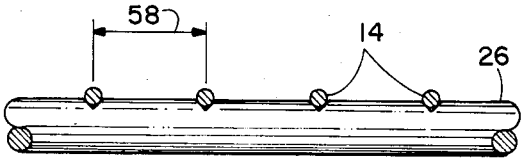
FIG. 9 is a fragmentary elevational view taken along lines 9—9 of FIG. 7.

In view of the foregoing explanation it will be apparent that under certain circumstances the separator may be sufficiently long so that it is desirable to shorten the unsupported length of the wires of the surface, thereby reducing the amplitude of vibration and ensuring that the effective spacing 54 anywhere on the separating surface does not exceed the exit interval 52". FIGS. 7, 8 and 9 show a panel having several intermediate bridges 26 which shorten the unsupported length of the wires. As may be seen in FIG. 9, the bridges do not extend above the tops of the wires 14 which form the separating surface. As may be seen in FIGS. 8 and 9, the bridges are notched or grooved on their tops and positioned slightly above the plane of the upstream and downstream lips so as to form an upwardfacing convex surface. The tension on the wires in combination with the convex shape of the surface forces the wires to be aligned and retained in the grooves of the bridges. If a plurality of bridges is employed in a surface, applicant has found it preferable to space them more frequently toward the downstream end of the separator to ensure that the effective spacing 54 does not exceed the exit interval 52".

With reference to FIG. 7, it will be understood that the effective spacing 54 upstream of a bridge 26 cannot exceed the bridge interval 58 or wedging could occur.

In operation, a flow of material to be separated, such as sand and gravel, is directed across the separating surface. Flow of the material across the screen may be encouraged by tilting the separator as well as by the inherent features of the separator. According to the principles of volumetric proportioning, the fan shape of the separator encourages the flow, since the path of the flow continuously increases in area in the direction of flow. The diverging wires of the surface also encourage the flow since particles falling through the wires relieve pressure downstream of the flow. Finally, the agitation of the surface encourages flow in several respects, the vibration reduces friction between the flow of material and the surface, but more significantly, the effect of the particles striking the oscillating wires throws the particles into suspension above the surface, further reducing friction with the surface and encouraging flow. Additional benefits associated with the highly tensioned lively separating surface is that when particles strike the highly tensioned and rapidly vibrating wires they do so with considerable force, aiding surface densification of the upper surface of the wires and making them more resistant to abrasion and wear.

As the material flows across the surface, the smaller particles fall through the wires of the surface near the upstream end 20' of the separator. Larger particles proceed toward the downstream 22' end of the separator and may pass through the wider effective spaces 54 of the surface. The particles too large to pass through the surface are carried off the downstream end.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A material separating surface for separating bulk material having particles of various sizes flowing across said surface comprising:

(a) an array of longitudinally-extending members extending substantially in the direction of material flow, said members arranged so as to create longitudinally extending spaces between adjacent ones of said members, said members diverging in the direction of material flow so that the width of said spaces increases in the direction of material flow;

(b) each of said members including tensioned wire means for oscillating individually in response to vibratory stimulus;

(c) said array including two or more discrete, interchangeable panels, each of said panels including a plurality of said wire means; and (d) frame means for supporting said tensioned wire means in diverging arrangement, said frame means including a plurality of longitudinally-extending compression members in diverging arrangement, said compression members being proximate to and substantially parallel to said tensioned wire means.

2. The surface of claim 1 wherein each of said panels may be removed from and installed in said array independently from other of said panels.

3. The surface of claim 1 wherein said wire means of said panels have a nominal yield strength and a nominal tensile strength, said wire means being tensioned in an amount proximate to or exceeding said yield strength but less than said tensile strength.

4. A material separating surface for separating bulk material having particles of various sizes flowing across said surface comprising:

(a) an array of longitudinally-extending members extending substantially in the direction of material flow, said members arranged so as to create longitudinally extending spaces between adjacent ones of said members, said members diverging in the direction of material flow so that the width of said spaces increases in the direction of material flow;

(b) each of said members including tensioned wire means for oscillating individually in response to vibratory stimulus;

(c) said array including two or more discrete, interchangeable panels, each of said panels including a plurality of said wire means; and (d) each of said panels including means for retaining said wire means in spaced relation to each other, said means including deformable adhesive.

* * * * *

UNITED STATES PATENT AND TRADEMARK OFFICE

CERTIFICATE OF CORRECTION

PATENT NO. : 4,696,738

DATED : September 29, 1987

INVENTOR(S) : Charles N. Risley

It is certified that error appears in the above-identified patent and that said Letters Patent is hereby corrected as shown below:

| | | |
|---|---|---|
| Col. 1, | Line 24 | Change "auch" to --such--. |
| Col. 2, | Line 4 | Change "aurface" to --surface--. |
| Col. 3, | Line 64 | Change "area." to --area,--; |
| Col. 3, | Line 65 | Change "34." to --34,--. |
| Col. 4, | Line 4 | Change "z-shaped" to --Z-shaped--; |
| Col. 4, | Line 34 | Change "enahles" to --enables--. |
| Col. 5, | Line 63 | Change "upwardfacing" to --upward-facing--. |

Signed and Sealed this

Tenth Day of May, 1988

*Attest:*

*Attesting Officer*

DONALD J. QUIGG

*Commissioner of Patents and Trademarks*